United States Patent [19]

Duss

[11] Patent Number: 5,005,192

[45] Date of Patent: Apr. 2, 1991

[54] METHOD OF AND APPARATUS FOR COUNTING FLAT OBJECTS IN A STREAM OF PARTIALLY OVERLAPPING OBJECTS

[75] Inventor: Hanspeter Duss, Baden, Switzerland

[73] Assignee: GRAPHA-Holding AG, Hergiswil, Switzerland

[21] Appl. No.: 407,058

[22] Filed: Sep. 14, 1989

[30] Foreign Application Priority Data

Sep. 30, 1988 [CH] Switzerland ..... 3654/88

[51] Int. Cl.[5] ..... G06M 7/10

[52] U.S. Cl. ..... 377/8; 377/49; 235/98 C

[58] Field of Search ..... 377/6, 7, 8, 49; 235/98 C

[56] References Cited

U.S. PATENT DOCUMENTS 4,217,491 8/1980 Dufford et al. ..... 377/8
4,296,314 10/1981 Dabisch et al. ..... 377/8
4,384,195 5/1983 Nosler ..... 377/8
4,450,352 5/1984 Olsson ..... 377/8
4,807,263 2/1989 Ohno ..... 377/8

FOREIGN PATENT DOCUMENTS 8505206 11/1985 United Kingdom ..... 377/8

*Primary Examiner*—John S. Heyman
*Attorney, Agent, or Firm*—Peter K. Kontler

[57] ABSTRACT

The sheets of a stream of partially overlapping sheets are counted during transport past a generator of ultrasonic waves which is operated by a control unit at a frequency such that each sheet reflects a series of successive waves. The resulting echoes are directed toward two discrete signal generators which transmit signals to an evaluating circuit by way of the control unit. The signals denote the length of intervals of propagation of waves from the source to the respective signal generators, and the circuit processes such signals to furnish information denoting the number of sheets which are conveyed past the locus of impingement of waves upon the sheets.

16 Claims, 1 Drawing Sheet

METHOD OF AND APPARATUS FOR COUNTING FLAT OBJECTS IN A STREAM OF PARTIALLY OVERLAPPING OBJECTS

BACKGROUND OF THE INVENTION

The invention relates to improvements in methods of and in apparatus for monitoring objects in streams of partially overlapping objects, also called scalloped or imbricated streams. More particularly, the invention relates to improvements in methods of and in apparatus for counting sheets, signatures, brochures, pamphlets, newspapers, newspaper sections and like flat objects in a continuous or interrupted stream of partially overlapping objects.

It is known to monitor flat objects (hereinafter called sheets for short) of a stream of partially overlapping sheets by directing a laser beam or a beam of infrared light against successive sheets of the stream and by evaluating the characteristics of the reflected beam. A drawback of such method and apparatus is that the reflectivity of conveyed sheets is likely to vary within a wide range, for example, because the quantity of printed matter varies from sheet to sheet or from a first group of successive sheets to the next group of successive sheets. Moreover, radiation from sources other than a laser or a source of infrared light is likely to distort the signals which are generated by reflected light. Still further, dust including finely comminuted fragments of paper sheets is also likely to affect the accuracy of the counting operation, the same as projecting portions of sheets which move across the path of propagation of a laser beam or a beam of infrared light.

OBJECTS OF THE INVENTION

An object of the invention is to provide a novel and improved method of monitoring, particularly counting, flat objects in a stream of partially overlapping objects in such a way that the evaluating operation is more reliable than in accordance with heretofore known methods.

Another object of the invention is to provide a method which is not affected by dust, by radiation from one or more sources other than those provided for the purpose of carrying out the method and/or other undesirable influences.

A further object of the invention is to provide a method which can be resorted to for monitoring of a series of successive partially overlapping objects at a high, medium or low frequency, which can be practiced with simple, compact and inexpensive apparatus, and which can be used for monitoring of a wide variety of small, large, wide, narrow, thick or thin objects with the same degree of efficiency and accuracy.

Still another object of the invention is to provide a novel and improved apparatus for the practice of the above outlined method.

An additional object of the invention is to provide the apparatus with novel and improved means for ascertaining the number of partially overlapping objects with a high degree of accuracy and irrespective of the speed at which the objects are conveyed past the monitoring station.

SUMMARY OF THE INVENTION

One feature of the present invention resides in the provision of a method of monitoring flat objects of a stream of successive partially overlapping objects, such as printed sheets, brochures, pamphlets, signatures, newspapers, sections of newspapers and the like. The method comprises the steps of conveying the stream of partially overlapping objects along a predetermined path, generating a series of ultrasonic waves, directing the ultrasonic waves of the series against successive objects of the stream in a predetermined portion of the path to thus produce ultrasonic echoes having characteristics which are indicative of the respective objects, and evaluating the echoes. The directing step can include directing a plurality of successive ultrasonic waves against each object of the stream during conveying of the objects along the predetermined portion of the path. Furthermore, the directing step can include transmitting successive waves from a first location at a first distance from the predetermined portion of the path, and the evaluating step can include utilizing the echoes for the generation of signals at a second location at a second distance from the predetermined portion of the path. Such second distance can match the first distance, and the second location can coincide (at least substantially) with the first location. The evaluating step can further comprise ascertaining the length or duration of intervals from transmission of waves at the first location to arrival of the respective echoes at the second location, comparing the intervals for each plurality of waves and the intervals for successive pluralities of waves, and utilizing the results of such comparing step to count the number of those objects which are conveyed along the predetermined portion of the path.

The evaluating step can further comprise utilizing the echoes for the generation of additional signals at a third location disposed at a third distance from the predetermined portion of the path. The direction of propagation of echoes from an object in the predetermined portion of the path to the second location preferably departs from the direction of propagation of echoes to the third location. The distance of such third location from the predetermined portion of the path departs or can depart from the distance of the first and/or second location from the predetermined portion of the path. The just discussed evaluating step can further comprise ascertaining the length or duration of intervals from transmission of waves at the first location to arrival of the respective echoes at the second and third locations, comparing the intervals of each plurality of waves and the intervals for successive pluralities of waves, and utilizing the results of such comparing step to count the number of those objects which are conveyed along the predetermined portion of the path.

The method can further comprise the step of collimating the waves between the first location and the predetermined portion of the path. The conveying step can include conveying the objects in a predetermined plane during transport along the predetermined portion of path, and the directing step can comprise propagating the waves from the first location substantially at right angles to the predetermined plane.

The second location can coincide, at least substantially, with the first location and, as already mentioned above, the evaluating step can include utilizing the echoes for the generation of additional signals at the third location at a third distance from the predetermined portion of the path and utilizing the first mentioned signals as well as the additional signals to count the number of objects which are conveyed along the predetermined portion of the path. The direction of propagation of echoes from the predetermined portion of the path toward the second location can be substantially counter to the direction of propagation of waves from the first location toward the predetermined portion of the path, and such direction of propagation of waves is inclined with reference to the direction of propagation of echoes from the predetermined portion of the path toward the third location.

Another feature of the invention resides in the provision of an apparatus for monitoring a stream of successive partially overlapping objects, particularly a scalloped stream of printed sheets, brochures, pamphlets, signatures, newspapers, newspaper sections or the like. The improved apparatus comprises means for conveying the stream along a predetermined path, a source of ultrasonic waves which is operable to transmit a series of waves in a predetermined direction against objects in a predetermined portion of the path with attendant generation of echoes as a result of reflection of waves upon the objects in the predetermined portion of the path, control means for operating the source at a predetermined (particularly at a variable) frequency, means for generating signals from the echoes, and means for evaluating the signals.

The means for generating signals can include a plurality of (e.g., two) discrete signal generators. Such discrete signal generators are or can be spaced apart from each other, and the echoes are preferably propagated in different directions on their way from objects in the predetermined portion of the path toward the discrete signal generators. The source can be coplanar with the discrete signal generators, and the conveying means can include means for maintaining objects in the predetermined portion of the path in a predetermined plane which is substantially normal to the common plane of the source and the discrete signal generators.

The direction of propagation of waves from the source to the predetermined portion of the path can coincide (at least substantially) with the direction of propagation of echoes from objects in the predetermined portion of the path toward one of the discrete signal generating means or toward the sole signal generating means.

The conveying means preferably defines a window in the predetermined portion of the path so that a wave which reaches the predetermined portion of the path while such portion is not occupied by an object is free to penetrate through the window. Such apparatus can further comprise means for reflecting those waves which penetrate through the window toward a selected signal generator or toward the sole signal generator. The selected signal generator or the sole signal generator is preferably disposed nearer to the window than to the reflecting means so that the intervals of propagation of echoes from objects in the predetermined portion of the path to the selected or sole signal generator are shorter than the intervals of propagation of reflected waves to the selected signal generator or to the sole signal generator.

The evaluating means can include at least one data processing unit, particularly a data processing unit including or constituting means for counting the number of objects which are conveyed along the predetermined portion of the path on the basis of signals from the signal generating means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
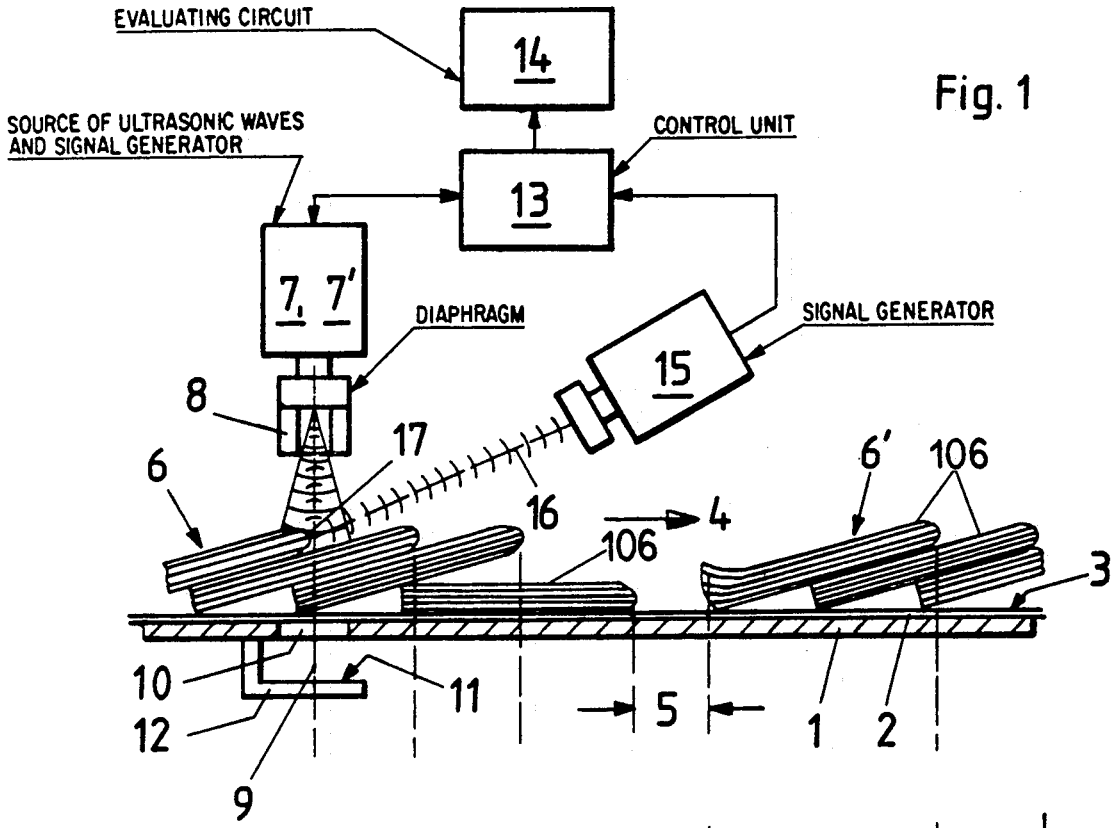
FIG. 1 is a schematic partly elevational and partly longitudinal vertical sectional view of an apparatus which embodies one form of the invention and operates with two spaced-apart signal generators.

The apparatus which is shown in FIG. 1 comprises a conveying means employing two or more belt conveyors 2 for advancing streams 6, 6' of partially overlapping signatures 106 (hereinafter called sheets) in the direction of arrow 4. The upper reaches of the belt conveyors 2 are propped by a support or platform 1 (e.g., a panel of sheet metal) so that the streams 6 and 6' are advanced in a substantially horizontal plane 3. The sheets 106 are assumed to be imprinted and are transported to storage, to a binding machine, to a gathering machine or to another destination. The streams 6 and 6' are parts of an interrupted longer stream and are formed as a result of unavoidable development of clearances or gaps (such as the gap 5) in a longer stream, e.g., due to removal of defective sheets 106.

The apparatus further comprises a source 7 of ultrasonic waves which are directed by a diaphragm 8 so that the direction (along the axis 9 of the source 7) of their propagation toward the sheets 106 in a predetermined portion of the path which is defined by the belt conveyors 2 with the platform 1 is disposed at right angles to the plane 3. The diaphragm 8 collimates the waves which are emitted by the source 7 (this source can constitute a standard ultrasonic generator which transmits waves at a frequency determined by a control unit 13) and causes the propagation of such waves along the axis 9 toward that sheet 106 which overlies a window or opening 10 provided in the platform 1 between the belt conveyors 2. The housing of the source 7 accommodates a first signal generator 7' which generates signals in response to detection of echoes (reflected sound waves) which propagate themselves along the axis 9 but counter to the direction of propagation of waves from the source 7 toward the (predetermined) path portion above the window 10.

The window 10 is disposed at a level above a bracket 12 which is affixed to or forms part of the platform 1 and has a reflecting surface 11 extending across the axis 9 to reflect those waves which happen to penetrate through the window 10 while the gap 5 is in register with the window. It will be seen that the distance of the reflecting surface 11 from the signal generator 7' is greater than the distance of the window 10 from the signal generator 7'; therefore, the length or duration of the interval of propagation of a wave from the source 7 to the sheet 106 which overlies the window 10 and thereupon to the signal generator 7' is shorter than the length or duration of the interval of propagation of a wave from the source 7 to the reflecting surface 11 and thence to the signal generator 7'.

When the belt conveyors 2 are in motion to transport the sheets 106 of the streams 6', 6 and the next-following streams (not shown) past the window 10, the waves which are emitted by the source 7 impinge upon the sheets 106 which happen to overlie the window 10. Such sheets are substantially horizontal and the path of waves from the source 7 toward the window 10 is substantially vertical. Electric signals which are generated by the signal generator 7' in response to detection of echoes from sheets 106 and in response to detection of echoes (reflected waves) from the surface 11 of the bracket 12 are transmitted to the control unit 13 which, in turn, transmits signals to an evaluating circuit 14. The control unit 13 further serves to transmit to the source 7 signals which initiate the transmission of ultrasonic waves toward the window 10, i.e., toward the sheet 106 which overlies the window 10 or toward the reflecting surface 11. The arrangement is preferably such that the source 7 transmits ultrasonic waves at a frequency which ensures that each sheet 106 which advances past the window 10 reflects several ultrasonic waves, i.e., the number of electric signals which are generated by the signal generator 7' during advancement of a stream 6' or 6 past the window 10 is several times the number of sheets 106 in the respective stream.

The apparatus which is shown in FIG. 1 further comprises a second signal generator 15 which is preferably coplanar with the source 7 and signal generator 7'. The common plane of the source 7 and signal generators 7', 15 is preferably normal to the plane 3. The axis 16 of the signal generator 15 is oriented in such a way that it intersects the back or fold line 17 of the sheet 106 which is about to reach or has just reached the common axis 9 of the source 7 and signal generator 7'. The second signal generator 15 is located downstream of the window 10 (as seen in the direction of arrow 4) because the orientation of sheets 106 in the streams 6 and 6' is such that the folded back 17 of each trailing sheet 106 overlies the trailing portion of the preceding sheet 106. The signal generator 15 is installed ahead of the window 10 if the inclination of sheets 106 in the streams 6' and 6 is reversed so that the folded backs 17 of sheets 106 overlie the leaders of the next-following sheets.

The signal generator 15 generates electric signals in response to detection of those echoes which develop as a result of reflection of ultrasonic waves from the source 7 by the folded backs 17 of successive sheets 106 at the station where the waves impinge upon successive sheets. The echoes propagate themselves in the direction of the axis 16, and the signal generator 15 transmits electric signals to the evaluating circuit 14 by way of the control unit 13. The axes 9 and 16 are coplanar and their common plane is normal to the plane 3. The distance which an ultrasonic wave covers from the source 7 to the sheet 106 above the window 10 and thence to the signal generator 15 is greater than the distance from the source 7 to the sheet 106 above the window 10 and thence to the signal generator 7'. The axes 9 and 16 make an acute angle.

In view of the aforediscussed mutual spacing of the signal generators 7', 15 and in view of different distances of these signal generators from the source 7, electric signals which are generated by the signal generators 7' and 15 in response to emission of an ultrasonic wave by the source 7 reach the evaluating circuit 14 with different delays. The circuit 14 processes the thus obtained signals to ascertain the length of intervals of travel of waves from the source 7 to the signal generator 7' and from the source 7 to the signal generator 15. This enables the circuit 14 to further ascertain the differences between the lengths or durations of the two intervals.

Figure 2:
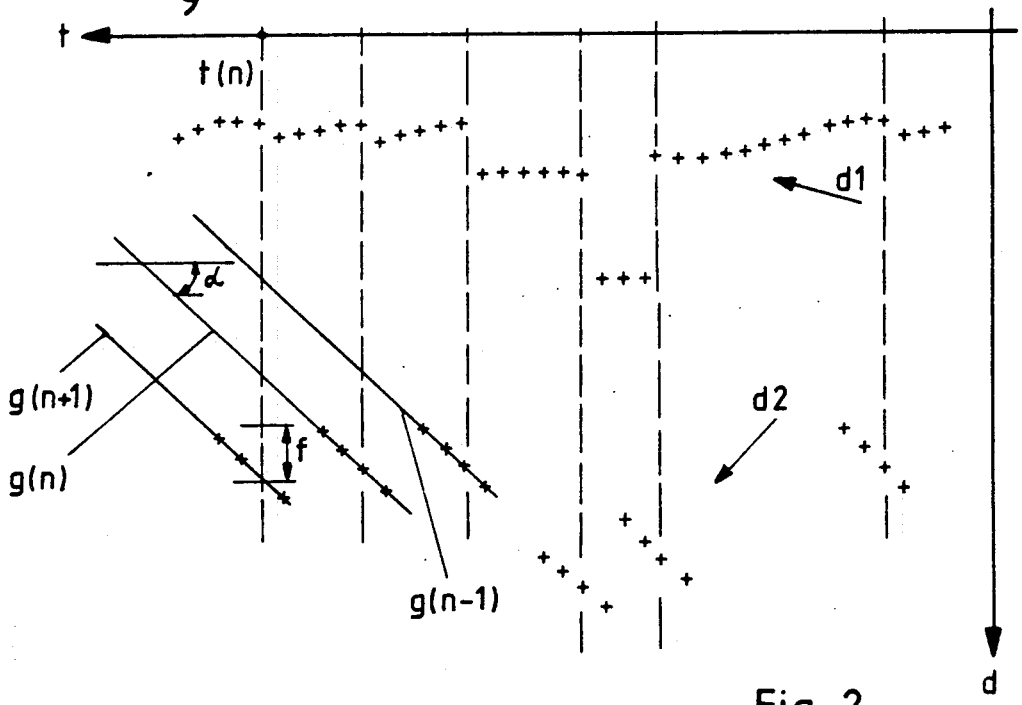
FIG. 2 is a diagram wherein the distance which is covered by echoes is measured along the ordinate and the length of intervals of propagation of waves between the source of such waves and the signal generators is measured along the abscissa.

FIG. 2 shows a diagram wherein the time t is measured along the abscissa and the distance d is measured along the ordinate. The distance d denotes the distance which is covered by an ultrasonic wave from the source 7 to the signal generator 7' or 15 and is calculated by the evaluating circuit 14. The orientation of the abscissa and ordinate in the diagram of FIG. 2 departs from the customary orientation and has been selected in the illustrated manner in order to conform to the sequence of steps which are carried out by the apparatus of FIG. 1. The symbols (+) of the series or row d1 are indicative of electric signals which are generated by the signal generator 7', and the symbols (+) of the series or row d2 are indicative of electric signals which are generated by the signal generator 15.

As mentioned above, the common axis 9 of the source 7 and signal generator 7' is normal to the plane 3 of the streams 6' and 6. Therefore, the distribution of symbols in the row d1 resembles the outlines or profiles of the streams 6' and 6, i.e., one can readily discern the outlines of successive sheets 106 in the two streams. The distance of symbols in the row d1 from the abscissa (t) denotes the information which is furnished by the evaluating circuit 14 and is indicative of the distances covered by successive echoes from the sheets 106 overlying the window 10 to the signal generator 7'. The symbols beneath the gap 5 are located at a greater distance d from the abscissa, i.e., such symbols of the row d1 clearly indicate that ultrasonic waves which were reflected by the surface 11 had to cover a greater distance than the waves which were reflected by the sheets 106 above the window 10.

The row d2 of symbols includes several substantially straight sections which are inclined with reference to the abscissa and with reference to the corresponding portions of the row d1. The reason for such configuration of the row d2 is that the folded back 17 of each sheet 106 is capable of reflecting waves toward the signal generator 15 (i.e., along the axis 16) only during the relatively short interval of advancement of the folded back 17 in the region of the axis 9, namely as long as the folded back 17 is in the range of waves which are emitted by the source 7 and are directed by the diaphragm 8. When the belt conveyors 2 are in motion, a folded back 17 which advances toward and beyond the axis 9 moves closer to the signal generator 15 and, therefore, the corresponding section of the row d2 slopes upwardly and to the left, as seen in FIG. 2, because the time t is measured in a direction to the left from the ordinate. The sections of the row d2 are straight because the speed of the belt conveyors 2 is assumed to be constant and also because the control unit 13 causes the source 7 to normally transmit ultrasonic waves at a fixed frequency.

The circuit 14 is programmed to evaluate electric signals from the control unit 13 (i.e., from the signal generators 7' and 15) in the following way (the purpose of the evaluating operation is to count the number of sheets 106 which have advanced past the window 10, i.e., along that predetermined portion of the path defined by the upper reaches of the belt conveyors 2 and by the platform 1 where the waves from the source 7 are reflected by the sheets 106 above the window 10).

(1) The control unit 13 transmits to the evaluating circuit 14 a signal each time (t(n)) the unit 13 transmits a signal to the source 7 to thus initiate the emission of an ultrasonic wave through the diaphragm 8 and along the axis 9 toward the window 10.

(2) The evaluating circuit 14 ascertains the length or duration of intervals which elapse from the instant of emission of an ultrasonic wave from the source 7 to the generation of a corresponding electric signal by the signal generator 7' and by the signal generator 15. This is represented in FIG. 2 by the distances of corresponding symbols (+) of the rows d1 and d2 from the abscissa.

(3) The evaluating circuit 14 ascertains whether or not the signal generator 15 has generated a signal at the instant t(n). In the absence of a signal, the circuit 14 is reset to zero, i.e., it is ready to begin a fresh evaluating operation from scratch when the control unit 13 transmits the next signal which initiates the emission of an ultrasonic wave from the source 7 toward the window 10.

(4) If a signal exists, the circuit 14 ascertains whether the signal from the signal generator 15 at the instant t(n) "fits" into the next-to-the-last straight section g(n−1) of the row d2. The circuit 14 is designed to calculate the straight section g of the row d2 for the fold line or folded back 17 of each sheet 106 and to memorize the corresponding information, namely at least the information denoted by the next-to-the-last section g(n−1) and by the last section g(n). Symbols of the section g(n−1) denote signals which are generated by the signal generator 15 on reception of echoes from the next-to-the-last folded back 17, and symbols of the section g(n) denote signals which are generated by the signal generator 15 on reception of echoes from the last folded back 17. A signal from the signal generator 15 "fits" into the respective section of the row d2 if the distance d of the corresponding symbol of the row d2 from the abscissa is shorter than a preselected maximum error. Otherwise stated, the distance d is less than a predetermined maximum deviation of the measured value from a preselected or anticipated value. For example, the maximum permissible error can equal half the distance f of a symbol in the row d2 at the instant t(n) from the last (i.e., preceding) straight section g(n) of the row d2.

If the symbol of the row d2 at the instant t(n) "fits" into the section g(n−1) in the aforedescribed manner, the evaluating circuit 14 is reset to zero in a manner and for the purposes as explained at (3) above.

(5) If the symbol of the row d2 does not "fit" into the next-to-the-last straight section g(n−1), the circuit 14 ascertains whether or not the symbol at the instant t(n) fits into the last straight section g(n). If the answer is in the affirmative, the circuit 14 is reset to zero.

(6) If the symbol of the row d2 at the instant t(n) does not fit into the last section g(n), the evaluating circuit 14 calculates a fresh straight section g(n+1). Moreover, the circuit 14 ascertains whether or not the signal from the signal generator 15 was generated by a folded back 17. To this end, the circuit 14 carries out a probability or plausibility test which involves ascertaining whether or not a signal was generated by the signal generator 7'. If the answer is in the affirmative, the circuit 14 memorizes, displays or otherwise furnishes a signal denoting the presence of a sheet 106 above the window 10. If the probability test is negative (e.g., because the gap 5 registers with the window 10), the circuit 14 is reset to zero without memorizing, displaying and/or otherwise furnishing a signal denoting the presence of a sheet 106 above the window 10.

The aforedescribed mode of operation of the circuit 14 in cooperation with the control unit 13 ensures a highly reliable counting of sheets 106 which advance past the window 10. The circuit 14 can comprise a suitably programmed microprocessor.

It is also within the purview of the invention to operate with a single signal generator (7' or 15) so that the circuit 14 then evaluates a single series of signals (namely those denoted by the symbols of the row d1 or those denoted by the symbols of the row d2). The utilization of a plurality of discrete signal generators is preferred at this time because the addition of one or more signal generators contributes very little to the cost and complexity of the apparatus while greatly enhancing the reliability of the monitoring operation of the circuit 14.

The apparatus of FIG. 1 and the method which can be practiced with this apparatus render it possible to accurately determine the speed of movement of the streams 6' and 6 in the direction of arrow 4. Since the evaluating circuit 14 ascertains the straight sections g(n−1), g(n) and g(n+1) of the row d2 of symbols denoting signals which are generated by the signal generator 15, the circuit 14 also contains information pertaining to the steepness or inclination of these sections of the row d2. Therefore, the circuit 14 can ascertain the angles alpha between such sections and the abscissa of the diagram of FIG. 2, i.e., also the tangent of the angle alpha. The value of tangent alpha is proportional to the speed of the streams 6' and 6. The circuit 14 can furnish to a suitable screen (not shown) signals which denote the value of tangent alpha and hence the speed of the belt conveyors 2 and streams 6', 6 in the direction of arrow 4.

The apparatus of the present invention can be used to ascertain the number of sheets 106 per unit of time irrespective of whether the belt conveyors 2 are driven at a very low speed or at a medium or very high speed. The speed of the belt conveyors 2 can vary between zero and a speed at which these belts transport up to and even in excess of 100 sheets 106 per second. The frequency of ultrasonic waves which are emitted by the source 7 is normally between 40 and 100 kilohertz, and the frequency at which the source 7 emits waves is preferably between 300 and 1000 hertz. For example, the distance of the source 7 and signal generator 7' from the locus of intersection of the axes 9 and 16 can be between 5 and 20 centimeters, and the distance of the signal generator 15 from the locus of intersection of the axes 9 and 16 can be between 5 and 30 centimeters.

The evaluating circuit 14 is preferably designed to ascertain the timing of generation of signals by the signal generators 7' and 15 as well as the intensity of such signals.

An advantage of the improved method and apparatus is that the reflectivity of sheets 106 to laser beams and/or infrared light cannot influence the accuracy of monitoring of such sheets by the evaluating circuit 14. Moreover, the influence of radiation other than ultrasonic waves from the source 7 upon the sheets 106 which move along the path above the platform 1 is nil. All this is achieved with the novel expedient of employing a source of ultrasonic waves, one or more signal generators which generate signals in response to detection of echoes of ultrasonic eaves, and the evaluating circuit 14.

An advantage of the control unit 13, which operates the source 7 at a frequency sufficing to ensure that each sheet 106 reflects a plurality of successive ultrasonic waves, is that it enables the circuit 14 to compare the characteristics of each plurality of signals as well as to compare the characteristics of a first plurality of signals with those of the next-following and/or preceding plurality of signals. Moreover, the circuit 14 can compare the intervals of propagation of an ultrasonic wave form the source to a sheet 106 above the window 10 with the intervals of propagation of echoes from sheets 106 to the signal generator 7' and/or 15. This enhances the ability of the evaluating circuit 14 to ascertain the presence of absence of a sheet 106 at the monitoring station adjacent the window 10.

The provision of a plurality of signal generators (including the illustrated signal generators 7' and 15) exhibits the advantage that the circuit 14 can receive signals denoting the impingement of successively emitted ultrasonic waves upon several signal generators which are spaced apart from one another and are disposed at different distances from the monitoring station at the locus of intersection of the axes 9 and 16. This enables the circuit 14 to distinguish between the fold lines or folded backs 17 and other irregularities, such as bent portions of sheets and fold lines or creases between bent portions and the remaining portions of the sheets. This, too, contributes to more reliable counting of the number of sheets which advance past the window 10. The ultrasonic generator 7 and the signal generator 7' form a unit of the type known as 3RG60 42 produced by Siemens AG, Erlangen Federal Republic Germany.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of monitoring flat objects of a stream of successive partially overlapping objects, particularly printed sheets, brochures, signatures, newspapers and sections of newspapers, comprising the steps of conveying the stream along a predetermined path; generating a series of ultrasonic waves; directing the ultrasonic waves of said series against successive objects of said stream in a predetermined portion of said path to thus produce ultrasonic echoes having characteristics indicative of the respective objects, including transmitting ultrasonic waves from a first location at a first distance from said portion of said path; detecting said echoes at a second location at a second distance from said portion of said path; ascertaining the length of intervals of transmission of waves at said first location to arrival of the respective echoes at said second location; comparing the intervals for each of said waves; and utilizing the results of said comparing step to count the number of those objects which are conveyed along said portion of said path.

2. The method of claim 1, wherein said directing step includes directing a plurality of ultrasonic waves against each object of the stream during conveying of objects a long said portion of said path.

3. The method of claim 2, further comprising the step of utilizing said echoes for the generation of additional signals at a third location at a third distance from said portion of said path.

4. The method of claim 3, wherein the direction of propagation of echoes from an object in said portion of said path to said second location departs from the direction of propagation of echoes to said third location.

5. The method of claim 3, further comprising ascertaining the length of intervals from transmission of waves at said first location to arrival of the respective echoes at said third location, an additional step of comparing the intervals for each of said pluralities of waves and the intervals for successive pluralities of waves, and utilizing the results of said additional comparing step to count the number of those objects which are conveyed along said portion of said path.

6. The method of claim 1, further comprising the step of collimating the waves between said first location and said portion of said path.

7. The method of claim 6, wherein said conveying step includes conveying the objects in a predetermined plane during transport along said portion of said path, said directing step comprising propagating said waves from said first location substantially at right angles to said plane.

8. The method of claim 1, wherein said second location substantially coincides with said first location, the direction of propagation of echoes from said portion of said path to said second location being substantially counter to the direction of propagation of waves to said predetermined portion of said path.

9. Apparatus for monitoring flat objects of a stream of successive partially overlapping objects, particularly printed sheets, brochures, signatures, newspapers and newspaper sections, comprising means for conveying the stream along a predetermined path; a source of ultrasonic waves operable to transmit a series of waves from a first location at a first distance from a predetermined portion of said path in a predetermined direction against objects in said predetermined portion of said path with attendant generation of echoes; means for operating said source at predetermined frequency; means for generating signals from said echoes at a second location at a second distance from said portion of said path; and evaluating means including means for ascertaining the length of intervals of transmission of waves from said first location to arrival of the respective echoes at said second location, means for comparing the intervals for each of said waves, and means for utilizing the results of comparison of said intervals to count the number of objects which are conveyed along said portion of said path.

10. The apparatus of claim 9, wherein said means for generating signals includes a plurality of discrete signal generators.

11. The apparatus of claim 10, wherein said discrete signal generators are spaced apart from one another and said echoes are propagated in different directions from the objects in said portion of said path toward said discrete signal generators.

12. The apparatus of claim 11, wherein said source and said discrete signal generators are disposed in a common plane.

13. The apparatus of claim 12, wherein said conveying means includes means for maintaining objects in said predetermined portion of said path in a second plane which is substantially normal to said common plane.

14. The apparatus of claim 9, wherein the direction of propagation of waves from said source to said portion of said path substantially coincides with the direction of propagation of echoes from objects in said predetermined portion of said path to said signal generating means.

15. Apparatus for monitoring flat objects of a stream of successive partially overlapping objects, particularly printed sheets, brochures, signatures, newspapers and newspaper sections, comprising means for conveying the stream along a predetermined path; a source of ultrasonic waves operable to transmit a series of waves in a predetermined direction against objects in a predetermined portion of said path with attendant generation of echoes, said conveying means defining a window in said portion of said path so that a wave which reaches said portion of said path while such path portion is not occupied by an object is free to penetrate through said window; means for operating said source at a predetermined frequency; means for generating signals from said echoes; means for reflecting waves which penetrate through said window toward said signal generating means; and means for evaluating said signals.

16. The apparatus of claim 15, wherein said signal generating means is nearer to said window than to said reflecting means so that the intervals of propagation of echoes from objects in said portion of said path to said signal generating means are shorter than the intervals of propagation of reflected waves to said signal generating means.

* * * * *